United States Patent [19]

Chapelsky et al.

[11] 4,453,653

[45] Jun. 12, 1984

[54] COLLAPSIBLE WALL CLOSURE FOR DISPENSERS

[75] Inventors: Orest Chapelsky, Ann Arbor; Norman A. Zausmer, Oak Park, both of Mich.

[73] Assignee: Michlin Diazo Products Corp., Detroit, Mich.

[21] Appl. No.: 202,852

[22] Filed: Oct. 31, 1980

Related U.S. Application Data

[63] Continuation of Ser. No. 891,096, Mar. 28, 1978, abandoned, which is a continuation-in-part of Ser. No. 688,037, May 19, 1976, Pat. No. 4,080,989.

[51] Int. Cl.[3] ..... B65D 47/22

[52] U.S. Cl. ..... 222/528; 222/530; 138/119; 251/4

[58] Field of Search ..... 222/212, 527, 528, 529, 222/530; 138/119; 251/4

[56] References Cited

U.S. PATENT DOCUMENTS

| | | | |
|---|---|---|---|
| 2,985,341 | 5/1961 | Howell | 251/4 X |
| 3,055,556 | 9/1962 | Hester | 222/530 X |
| 3,181,743 | 5/1965 | Libit et al. | 222/528 |
| 3,244,331 | 4/1966 | Kharasch | 222/528 X |
| 3,392,887 | 7/1968 | Bross | 222/528 |

*Primary Examiner*—Joseph J. Rolla
*Assistant Examiner*—Frederick R. Mandren
*Attorney, Agent, or Firm*—Krass and Young

[57] ABSTRACT

A collapsible wall closure for a dispenser nozzle comprised of a stiff but resilient tube section adapted to be bent over and latched in the bent position to provide a fluid tight closure of the nozzle by collapse of the tube wall. The interior of the nozzle tube is undercut in the region of the wall collapse on either side of the tube along the fold line of the tube, in order to provide complete sealing collapse of the tube wall in the bent position. The undercuts are comprised of shallow grooves extending axially along the tube interior thinning the tube wall thickness in the region of the wall collapse. A pair of closures are incorporated in a cap closure particularly adapted to an ammonia hydroxide container for connection to vapor-type diazo reproduction machines.

2 Claims, 10 Drawing Figures

Fig-1
PRIOR ART
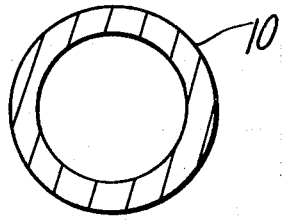
Fig-2
PRIOR ART
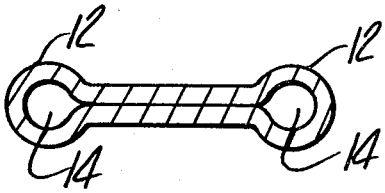
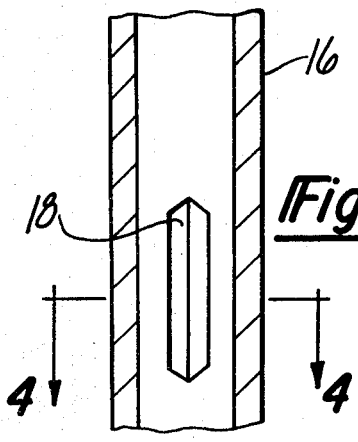
Fig-3
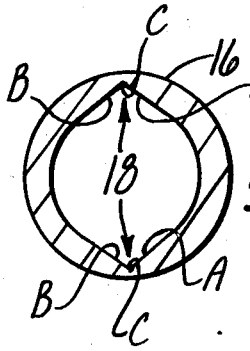
Fig-4
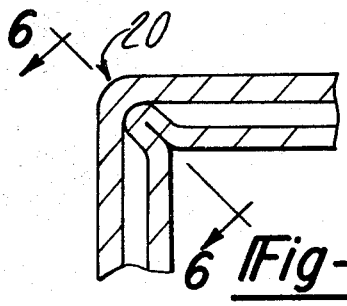
Fig-5
Fig-6
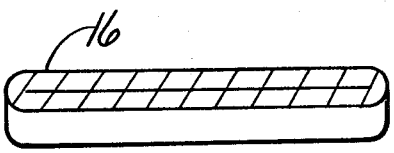

COLLAPSIBLE WALL CLOSURE FOR DISPENSERS

CROSS REFERENCE TO RELATED APPLICATION

This application is a continuation of application Ser. No. 891,096, filed Mar. 28, 1978, now abandoned, which was a continuation-in-part of Ser. No. 688,037, filed May 19, 1976, now U.S. Pat. No. 4,080,989.

BACKGROUND DISCUSSION

This invention concerns closures and more particularly collapsible wall type closures particularly suited for fluid dispensing applications.

It has heretofore been known in the art to provide a closure comprised of a relatively stiff tube of a resilient material such as polyethylene plastic which forms a dispensing nozzle as by being integral with a fluid container closure cap. Upon being bent over, the tubular nozzle collapses along the line of bending, with such collapse affording the closure of the nozzle. A suitable latching means is used to hold the tube in the bent position. The material is sufficiently stiff and resilient such that upon release of the latching means, the tubular nozzle will reposition itself and the interior of the tube wall recovering its shape will again allow dispensing of liquid through the nozzle interior.

Examples of such designs are disclosed in U.S. Pat. Nos. 3,181,743 and 4,080,989.

The material of which the tube is constructed in order that the tube be adapted to recover its position upon release of the latching means indicates that the material must be reasonably stiff while being resilient. This material stiffness requirement may result in failure of the tube to completely collapse upon bending of the tube.

Accordingly, it is the object of the present invention to provide a collapsible tube closure particularly adapted for fluid dispensing applications in which a complete collapse of the tube wall takes place upon bending of the tube to a fluid tight closure thereof.

SUMMARY OF THE INVENTION

This and other objects of the present invention, which will become apparent upon a reading of the following specification and claims, are accomplished by providing a round tube section formed with undercuts in the tube interior in the region at which the tube is to be bent. The undercuts are located on opposite sides of the tube wall in a direction parallel to the tube bend line and are configured as shallow vee grooves extending along the tube axis. The reduced wall thickness produced in the opposite sides of the tube at the bottom of the vee groove ensures that the tube wall in that region may be completely collapsed upon folding of the tube. This is produced by movement of each of the vee groove sides into contact with each other accommodated by bending of the relatively thin wall thickness at the depth of the groove.

The tube segment is incorporated into a dispenser tube nozzle which is of stepped shape having a large diameter section transitioned into a small diameter section at the point whereat the tube bending is to take place in order to insure that bending will occur just above the transition in the smaller diameter section. The smaller diameter section of the tube immediately adjacent the transition is provided with the oppositely located vee groove undercuts to produce the complete closure at the bending line so created.

DESCRIPTION OF THE DRAWINGS

FIG. 1 is a sectional view of a conventional prior art collapsible tube closure prior to being bent or folded to collapse the wall.

FIG. 2 is a view of the section shown in FIG. 1 along the line of the tube bending depicting the tube shape after bending.

FIG. 3 is a longitudinal sectional view of a tube section incorporating an undercut provided according to the present invention.

FIG. 4 is a transverse sectional view of the tube section depicted in FIG. 3.

FIG. 5 is a longitudinal sectional view of the tube section shown in FIG. 3 in the folded or bent position.

FIG. 6 is a transverse sectional view of the tube segments shown as folded in FIG. 5 and taken through line 6—6 at the fold line.

DETAILED DESCRIPTION

Figure 7:
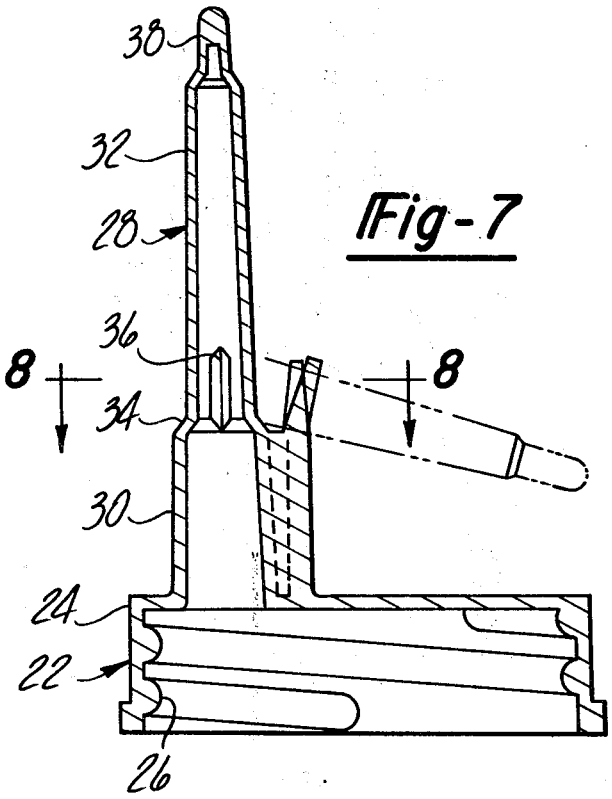
FIG. 7 is a sectional view of a closure cap incorporating collapsible wall tube closures according to the present invention, depicting in phantom the position of a tube closure in the folded and latched position.

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations with the scope of the appended claims.

Referring to the drawings and particularly the PRIOR ART FIGS. 1 and 2, a section taken through a collapsible wall closure tube of the sort described is depicted shown in section. In FIG. 1, the tube 10 is in its relaxed shape before bending or folding thereof and has a generally constant wall thickness to have an annular shape in section.

Upon folding or bending of the tube such as to attempt to collapse the tube wall, the tube wall portions 12 on opposite sides of the tube wall in the region of the bend must be bent into a very small radius of curvature. If the material is reasonably stiff, the result is often the formation of openings 14 created by a failure of the tube wall portions 12 to collapse. These openings 14 are located on diametrically opposite sides along the direction of the fold line of the tube 10 and are a result of the failure of the tube material to impose sufficient stresses on the tube wall portions 12 to produce complete collapse.

The tube section 16, which acts as a collapsible wall closure, is provided with a pair of oppositely located undercuts 18 on diametrically opposite sides of the tube section 16 along a line parallel to the fold line formed when the tube section 16 is folded over to collapse the walls of the tube section 16.

These undercuts 18 are comprised of shallow vee-shaped grooves extending parallel to the tube axis along the segment of the tube 10 to be folded. The vee grooves are formed by tapering flat surfaces which begin approximately at lines A and B, tangent to the inside surface of the tube and converging at the bottom of the vee groove C. The shallow vee grooves provide a gradual increase in the wall thickness of the tube section 16 to a minimum at the bottom of the vee groove.

Referring back to FIG. 2, the tube wall portions 12 of the tube 10 correspond to the portion of the tube section 16 which is reduced in thickness by the undercuts 18, with the reduction in thickness achieved along C accommodating the maximum being required at the extreme end points of the folded tube.

When bending occurs parallel to the a line extending through the bottoms of the vee grooves, this relief allows the interior portion of the tube section 16 to move together under the collapsing forces exerted on the tube section 16 to provide a complete seal as can be seen by reference to FIGS. 5 and 6. The section shown in FIG. 6 is taken at 6—6 directly across the bend line 20 when the tube is folded over to provide a closure by collapse of the interior.

The presence of the undercuts 18 produces complete collapse of the tube section 16 as shown in FIG. 6 with the interior surface of the tube 10 being in intimate contact entirely across the bend line 20.

In effect, the tube section 16 and the undercut 18 pivot toward each other along the vee bottom C, under the collapsing force, the relatively flat portions of the vee groove sides moving into sealing engagement with each other.

The shallowness of the vee groove precludes any tendency for the cusps of the transitions between the vee groove sides and the unrelieved wall interior to result in small openings between the collapsed walls.

The undercuts 18 may either be molded in or formed by any other suitable forming process.

Referring to FIGS. 7 through 10, a particular application of the collapsible wall closure according to the present invention is depicted which comprises a closure cap 22 formed of a resilient molded plastic material such as polyethylene plastic. Cap 22 includes a body portion 24 which is formed with suitable threads 26 to mate with a fluid holding container such as a bottle, such that the cap 22 provides a closure therefor.

A pair of dispenser nozzle tubes 28 are integrally molded with the tubes, each being of stepped shape, having a first large diameter section 30 integral with the cap body portion 24 and a second smaller diameter section 32 joined by an intermediate transition section 34 to the large diameter section 30. The interior of each of the dispenser nozzle tubes communicates with the inside of the cap body portion 24 to establish fluid communication with the interior of the fluid container.

As noted, the cap body portion 24 and dispenser nozzle tubes 28 may be constructed of relatively stiff but resilient material such as polyethylene plastic having a wall thickness on the order of 0.040 inch.

The small diameter section 32 comprises the collapsible tube closure according to the present invention and accordingly is provided with undercuts 36 as depicted in FIGS. 3 through 6.

Figure 8:
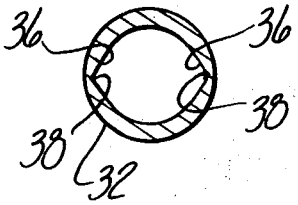
FIG. 8 is a view of the section 9—9 taken in FIG. 7.
Figure 9:
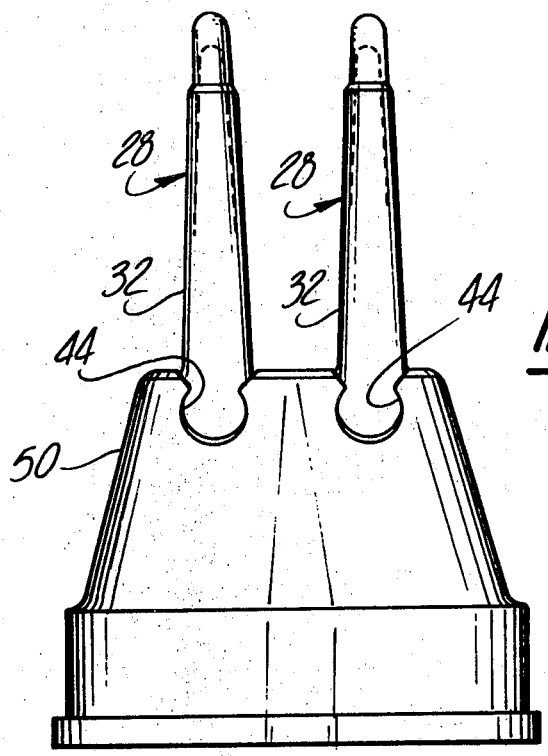
FIG. 9 is a front elevational view of the closure cap depicted in FIG. 7.

As seen in FIG. 8, these undercuts 36 as before comprise the shallow vee-shaped grooves with the bottom of the vee located on either side of the tube wall of the small diameter section 32 on opposite sides of the bending line produced by folding of the dispenser nozzle tube 28. Each of the undercuts 36 is located just above the large diameter section 30 since the relatively more stiff large diameter section 30 will cause the preferential bending to occur in the small diameter section 32 at a point just above the intermediate transition section 34. Thus, the undercuts 36 extend along a length of each of the small diameter sections 32 just above the intermediate transition section 34.

Each of the small diameter sections 32 is molded with a solid end portion 38 which is severed to open the closure and allow communication of the interior of the fluid container sealed by the cap 22 through the dispenser nozzle tubes 28.

Latching means is provided for securing each of the small diameter sections 32 in the folded-over position as indicated in phantom in FIG. 7 with a fold line extending parallel to a line extending through the bottoms of the vee grooves. The latching means includes latching web 40 also formed integrally with cap body portion 24, with a pair of stiffener webs 42 serving to stiffen the latching web 40 to maintain its position upon engagement with the outside of the small diameter section 32.

A pair of latching cutouts 44 is provided which are suitably sized and located at a corresponding distance above the cap body portion 24 to allow the small diameter section 32 to be squeezed into the opening but frictionally retain the same in the folded-over position to thereby latch the small diameter section 32 in the folded-over position. This enables maintenance of the closure produced by collapse of small diameter section 32 and thereby seals the interior of the container.

As described in U.S. Pat. No. 4,080,989, this type of closure is advantageously applied to containers for ammonia hydroxide solutions. For containers containing such solution, tubes are provided (not shown) extending downwardly into the interior of the bottle, one in the interior of each of the large diameter sections 30. One of the tubes extends into the solution, whereas the other tube is shorter and terminates short of the liquid level in the bottle. There is a danger in first cutting the solid end portion 38 of the tube extending into the liquid in that a vapor pressure may exist in the interior of the bottle sufficient to force the liquid contents out under pressure.

The ammonia hydroxide is caustic and thus may cause injury or damage.

Figure 10:
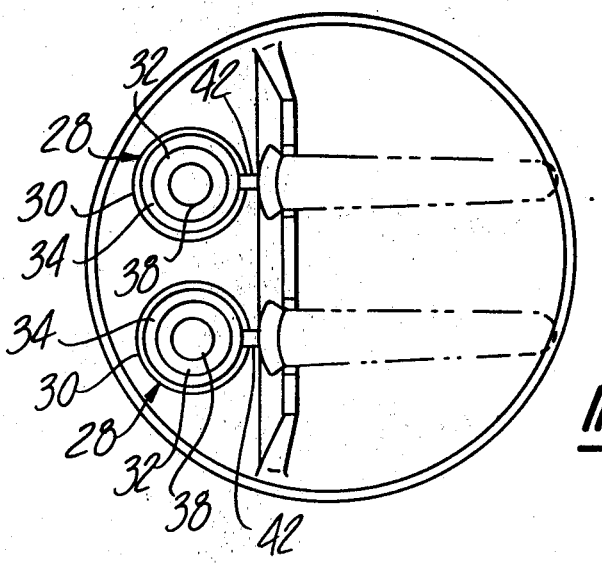
FIG. 10 is a plan view of the closure cap depicted in FIG. 7 and 9.

Accordingly, the caps 22 may be formed with molded legends indicating the order in which the dispenser nozzle tubes 28 are to be cut, as per the legends shown in FIG. 10.

Accordingly, it can be seen that by this arrangement the complete sealing collapse of the interior of the tube is insured by the provision of the shallow vee grooves on either side of the wall along the bend line in the region of the tube which is folded in order to produce the collapse of the wall, with the opposite sides of the vee grooves coming together upon collapse. The minimum wall thickness at the depth of each groove accommodates such collapse.

It can be appreciated that this arrangement is very simple and will add little or no cost to the cost of manufacture since the undercuts may be formed during the molding process, whereby no additional manufacturing costs are entailed. This insures that such complete closure will take place regardless of the stiffness or resilience of the material or the particular wall thickness utilized. The extent of the undercut depends partially on the material, but in general should correspond to the tube wall portions 12 depicted in FIG. 2.

In one particular embodiment, the undercuts were formed by legs of the vee extending at an angle of 60° to the bend line and transitioning tangentially into the inside tube surface with a maximum wall thickness of 0.040 inch, and a minimum wall thickness at the depth of the vee groove on the order of approximately one-half that thickness, i.e., 0.020 inch, for tubing of 0.250 inch outside diameter.

The embodiments of the invention in which an exclusive property or privilege is claimed are defined as follows:

1. A closure comprising:

a cap adapted to be secured to a fluid container to be sealed thereby, said cap including a cap body;

a tube nozzle extending from said cap body, the interior of said tube nozzle extending through said cap body to thereby be placed in communication with said container to be sealed by said cap, said nozzle being of stepped shape comprising a large diameter section adjacent said cap body, further including a small diameter section remote from said cap body and also including a transition section joining said large diameter section to said small diameter section;

a pair of undercuts formed in the interior of said tube nozzle and intermediate its length thereof, said undercuts located diametrically opposite each other in said small diameter tube section adjacent said transition section, said undercuts comprising vee-shaped grooves extending along a segment of said interior of said tube nozzle, the bottom of said vee-shaped grooves axially extending parallel to the axis of said tube nozzle and providing a reduced wall thickness of said tube nozzle at opposite points thereof, said tube nozzle being formed of a resilient material, whereby said tube may be folded in the region of said undercuts to produce complete sealing of said tube nozzle by collapse of said tube nozzle wall in the region of said undercuts, said undercuts affording complete collapse of said tube at opposite regions of said tube nozzle along bend lines formed by folding over of said tube nozzle.

2. The closure according to claim 1 further including latching means for securing said tube nozzle in a folded-over position, said latching means including a latching web having a cutout formed to frictionally receive and retain said small diameter section and said cutout being located at a distance above said cap body corresponding to the distance by which said tube nozzle is bent over at said undercut regions to frictionally engage said small diameter section of said tube nozzle.

* * * * *